US009365327B2

(12) United States Patent
Lepoutre

(10) Patent No.: US 9,365,327 B2
(45) Date of Patent: Jun. 14, 2016

(54) PACKAGING FOR A BOUQUET OF FLOWERS

(71) Applicant: CLAYRTON'S, Roubaix (FR)

(72) Inventor: Alban-Josse Lepoutre, Villeneuve d'Ascq (FR)

(73) Assignee: CLAYRTON'S, Roubaix (FR)

( * ) Notice: Subject to any disclaimer, the term of this patent is extended or adjusted under 35 U.S.C. 154(b) by 0 days.

(21) Appl. No.: 14/075,960

(22) Filed: Nov. 8, 2013

(65) Prior Publication Data

US 2014/0131239 A1 May 15, 2014

(30) Foreign Application Priority Data

Nov. 12, 2012 (FR) ..... 12 60752

(51) Int. Cl.

| | |
|---|---|
| ***B65D 85/52*** | (2006.01) |
| ***B65D 33/28*** | (2006.01) |
| ***B65D 85/50*** | (2006.01) |
| ***A47G 7/06*** | (2006.01) |

(52) U.S. Cl.

CPC ..... *B65D 33/28* (2013.01); *A47G 7/063* (2013.01); *B65D 85/505* (2013.01)

(58) Field of Classification Search

CPC .... B65D 33/28; B65D 7/55827; A47G 7/063; B65F 1/002; B65F 1/0006; B65F 1/068; B65F 1/06; B65F 2001/061

USPC ..... 220/495.08, 495.06, 495.11; 206/423

See application file for complete search history.

(56) References Cited

U.S. PATENT DOCUMENTS

| | | | | |
|---|---|---|---|---|
| 4,799,520 | A * | 1/1989 | Blackburn et al. | 206/423 |
| 8,556,101 | B2 | 10/2013 | Delatour et al. | |
| 2012/0067876 | A1* | 3/2012 | Delatour et al. | 220/4.28 |

FOREIGN PATENT DOCUMENTS

| | | | |
|---|---|---|---|
| EP | 1944239 | A1 | 7/2008 |
| FR | 2946025 | B1 | 12/2010 |

* cited by examiner

*Primary Examiner* — Anthony Stashick
*Assistant Examiner* — James M Van Buskirk
(74) *Attorney, Agent, or Firm* — Neal, Gerber & Eisenberg LLP

(57) ABSTRACT

A packaging for a bouquet of flowers is disclosed. The packaging includes a packaging foil impermeable to water, designed to constitute a water reservoir, onto which is glued a reinforcing element designed to shape said packaging, said reinforcing element including a base around which are distributed, at an angle, arms directed in directions, specifically radial, around the base and articulated at said base. The arms are provided with loops in their upper part, said packaging including two independent drawstrings, called the first and second drawstring. In one embodiment, the two drawstrings pass successively through a number of the loops, and each drawstring exhibits an area for grasping. The two drawstrings pass respectively through two orifices of two diametrically opposed arms, such that the grasping areas are diametrically opposed.

20 Claims, 4 Drawing Sheets

PACKAGING FOR A BOUQUET OF FLOWERS

CROSS-REFERENCE TO RELATED APPLICATIONS

This application claims priority to French Patent Application FR 1260752, filed on Nov. 12, 2012, which is incorporated by reference in its entirety.

BACKGROUND OF THE INVENTION

The present invention concerns the field of packaging for a flower bouquet, and, more precisely, of packages with a store of water.

In general, such packaging devices for flower bouquets include a packaging film, watertight, made of a plastic material designed to constitute a store of water, and a support element for reinforcement, very often made of a rigid or semi-rigid plastic material designed to give its shape to the packaging and to allow the packaging to be held stable on a horizontal surface. Once the packaging is shaped, the watertight film wrapped on the support element, and the store of water made up, a tie allows the foil to be tied on the support, holding the stems of the bouquet.

The positioning of such a packaging requires several more or less time-consuming operations to be accomplished, that is, the positioning of the support, the positioning of the film, a step shaping the foil on the support, filling the foil with water, and inserting the bouquet stems, and then tying the packaging thus formed. Quite often, the operator has to make use of a specific work station for these operations, such as, for example, that disclosed in the document EP 1944239A1, or similar.

In order to remedy these drawbacks, the document FR 2 946 025 proposes a packaging that includes, on the one hand, a first part made up of two flexible foils, one decorative and the other watertight, combined with a flexible frame made of plastic in the shape of a star including several deformable branches and, on the other hand, a rigid shaper attached to the base of the flexible frame, designed to interact with the branches and to give its final shape to the packaging. A sheath is disposed on the periphery of the watertight foil in such a way as to have a single string pass through, which operates together with the end of the branches to straighten them and shape the packaging.

Such a device allows the packaging to be shaped by attaching the shaper to the flexible frame, and then exerting a pulling action on the string. Pulling on the string allows the branches of the frame to be brought together until they stop at the arms of the shaper and thus form the packaging.

Such a device has one drawback, however, in wasting storage space, several distinct parts (the flexible frame and the shaper) being required in order to accomplish the packaging. It is not possible to obtain the final shape of the packaging using only the string and the flexible frame without the presence of the shaper. The shaper is thus an essential element of the device which, due to its rigidity and its bulkiness, will not facilitate storage of the device.

Such a device always necessitates the execution of several operations, which involves a loss of time.

Such a device thus represents a non-negligible cost due to the necessity of having several parts to store and assemble.

SUMMARY OF THE INVENTION

The invention specifically has the objective of compensating for the various drawbacks of the foregoing known techniques.

More precisely, one objective of the invention is, at least in one particular embodiment, to limit the number of operations necessary to accomplish the packaging.

Another objective of the invention is, at least in one particular embodiment, to provide a packaging that is easy to achieve.

The invention likewise has as an objective, at least in one particular embodiment, that of providing a packaging that is easy to store.

Yet another objective of the invention is, at least in one particular embodiment, that of providing an ecological and readily recyclable packaging.

These objectives, as well as others that will appear more clearly in the following, are attained according to the invention with the aid of a packaging for a bouquet of flowers including a packaging foil impermeable to water, designed to constitute a water reservoir, onto which is glued a reinforcing element designed to shape said packaging, said reinforcing element including a base around which are distributed, at an angle, arms directed in directions, specifically radial, around the base and articulated at the said base.

According to the invention, the said arms are provided with loops at their upper part, the said packaging including two independent drawstrings, called the first drawstring and second drawstring, the said two drawstrings passing through each of the loops successively, each drawstring exhibiting an area for grasping, the said two drawstrings passing through two orifices, respectively, of the two said diametrically opposed arms in such a way that the areas for grasping are diametrically opposed, and the said packaging can go from a flat position in which the base and the arms of the said reinforcing element are roughly in the same plane to a three-dimensional position, by pulling simultaneously on the drawstrings and exerting two forces in opposite directions on the grasping areas.

The invention can, in addition, exhibit the following optional characteristics.

According to an advantageous aspect of the invention, the said first tie can pass through one of the loops disposed on the arm accommodating the orifice that the said second tie passes through, and the said second tie can pass through another of the loops disposed on the arm accommodating the orifice that the said first tie passes through.

According to a particularly simple approach, each orifice can include means of tightening the drawstrings.

Advantageously, the means of tightening can form a single element with the orifice.

Preferentially, the drawstrings pass respectively through two orifices in the foil that are juxtaposed to the orifices of the said arms.

According to one particular aspect of the invention, the said bases of the said arms are widened in such a way as to butt up against one another in the three-dimensional position and to form a crown in the three-dimensional position of the packaging device.

According to the invention, each drawstring forms a continuous loop, with the area for grasping each drawstring forming a noose when said packaging is in the three-dimensional position.

Advantageously, the said packaging foil, said reinforcing element, and said drawstrings are of the same plastic material, polypropylene in particular.

According to one particular aspect of the invention, at least two diametrically opposed arms exhibit, at their end, hooks directed downward.

The invention likewise concerns an assembly designed to be suspended vertically and including superposition of several packages conforming to the invention in their flat position, as well as a suspension device designed to mutually hold the packages by the intermediary of a detachable extension of each packaging foil.

Other characteristics and advantages of the invention will appear more clearly in reading the following description of a particular embodiment of the invention, given by way of a simple illustrative and non-restrictive example, and of the appended drawings.

DETAILED DESCRIPTION

As previously mentioned, the general principle of the invention thus lies in the implementation of a packaging 1 for a bouquet of flowers, including a packaging foil 10 impermeable to water, and preferably with a circular shape, designed to constitute a reservoir of water in which the stems of the flower bouquet will rest.

Figure 1:
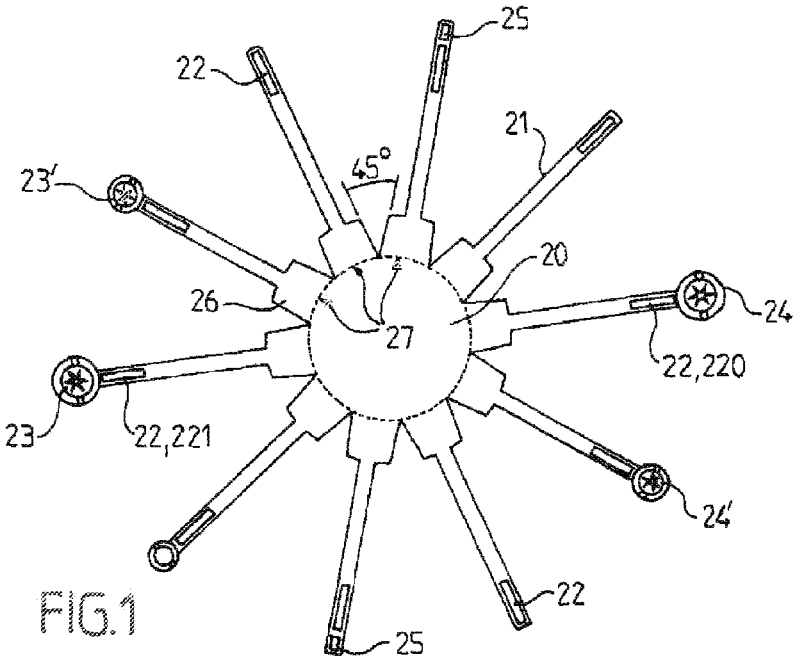
FIG. 1 is a view from below of the reinforcing element of the packaging according to one embodiment of the invention.

A reinforcing element 2, illustrated in FIG. 1, is designed to provide the shape of the packaging, the reinforcing element 2 including a base 20 glued to the center of the packaging foil 10, preferably circular, around which arms 21 are distributed, at an angle, glued at their free end to the packaging foil 10, said arms preferably directed in radial directions around the base 20 and articulated at said base 20, particularly by the intermediary of flexible joints 27.

According to one particular embodiment of the invention, the packaging foil 10 and the reinforcing element 2 are made of the same plastic material, such as polypropylene.

Advantageously, the size of the arms 21 can be varied as a function of the packaging desired and the size of the flower bouquet. Generally, the size of the arms is less than the dimensions of the packaging foil 10 so as to completely hide the reinforcing element 2 once the packaging is shaped, or even to leave a very large part of the foil intended to be fashioned manually to make the packaging 1 pretty.

Figure 3:
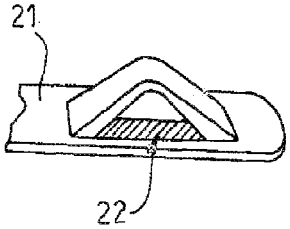
FIG. 3 is a perspective view of a loop of an arm of the support element.
Figure 4:
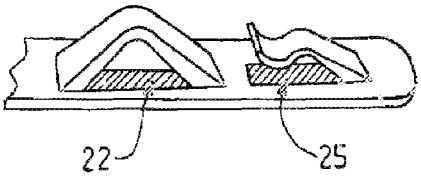
FIG. 4 is a perspective view of an arm of the support element, provided with a hook.

According to the invention, each arm 21 is provided with a loop 22, illustrated on FIG. 3, at its upper part, which is designed to operate together with at least one or the other of the two drawstrings 3 and 4, the two drawstrings 3 and 4 being independent of one another. The drawstrings 3 and 4 can also be executed of a plastic material, preferably the same as that of the packaging foil and the reinforcing element so as to facilitate recycling.

Figure 9:
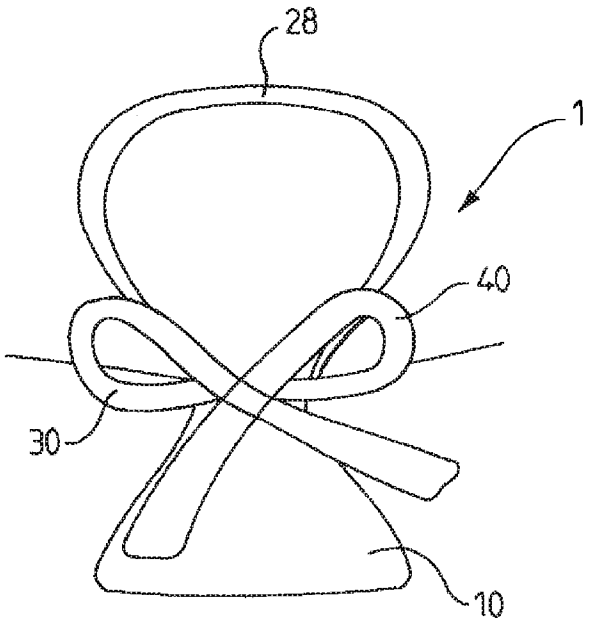
FIG. 9 is a schematic view illustrating a packaging provided with a detachable noose.

According to a particular embodiment of the invention, illustrated on FIG. 9, at least two diametrically opposed arms 21 exhibit, at their end, hooks 25 directed downward so as to be able to hang a detachable noose 28 thereon, for example, the two grasping areas 30 and 40 forming a decorative knot.

The two drawstrings 3 and 4, the said first and second drawstring, pass respectively through two orifices 23', 24' of two diametrically opposed arms 21 in such a way that each drawstring 3, 4 exhibits an area for grasping, the grasping areas 30 and 40 then being diametrically opposed.

Figure 8:
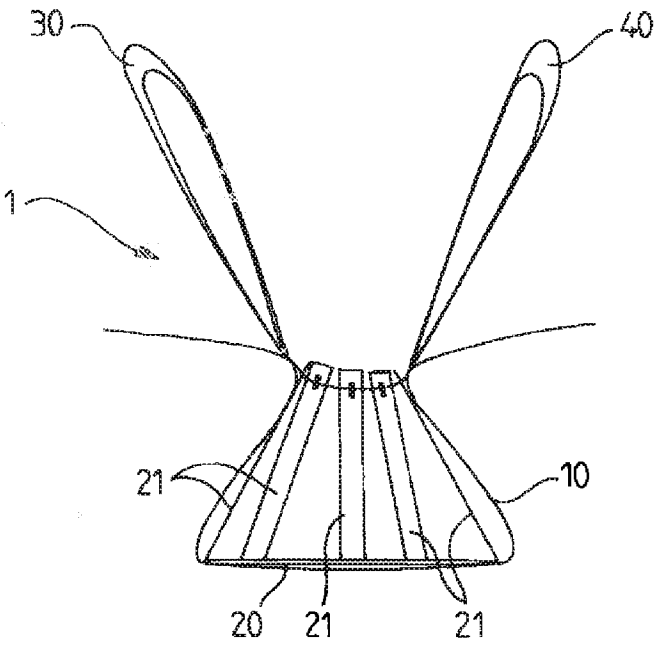
FIG. 8 is a view along a vertical section, illustrating a shaped packaging.

Advantageously, each drawstring 3, 4 preferably forms a continuous loop, the grasping area 30, 40 of the drawstrings being able to form a noose when the reinforcing element 2 is in the three-dimensional position, so as to facilitate transport of the bouquet, as illustrated in FIG. 8.

According to the invention, the two drawstrings 3 and 4 each pass successively through all or part of the loops 22 disposed in the upper part of the arms 21. Preferentially, the drawstrings 3 and 4 pass successively through each of the diametrically opposed loops 22.

According to one illustrated embodiment, the first drawstring 3 does not pass through the loops 22 of arms 21 adjacent to arm 211 accommodating orifice 23 and it then passes successively through the other loops 22, and the second drawstring 4 does not pass through the loops of the arms adjacent to arm 210 accommodating orifice 24 and it then passes successively through the other loops 22.

Figure 5:
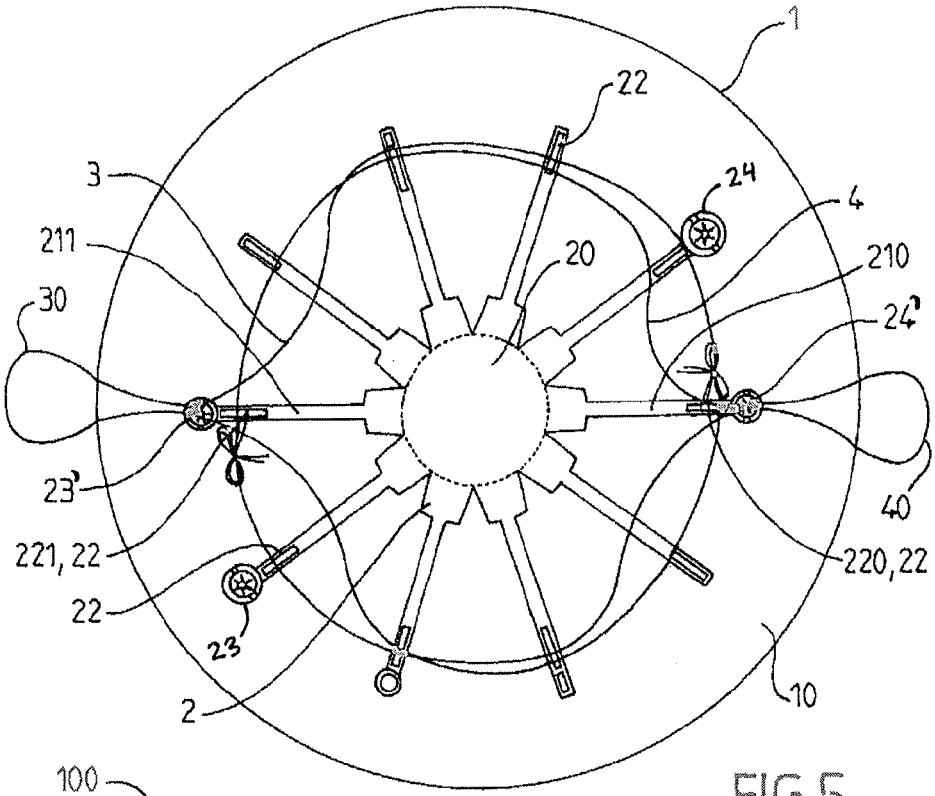
FIG. 5 is a view from below of the packaging according to one embodiment of the invention.
Figure 7:
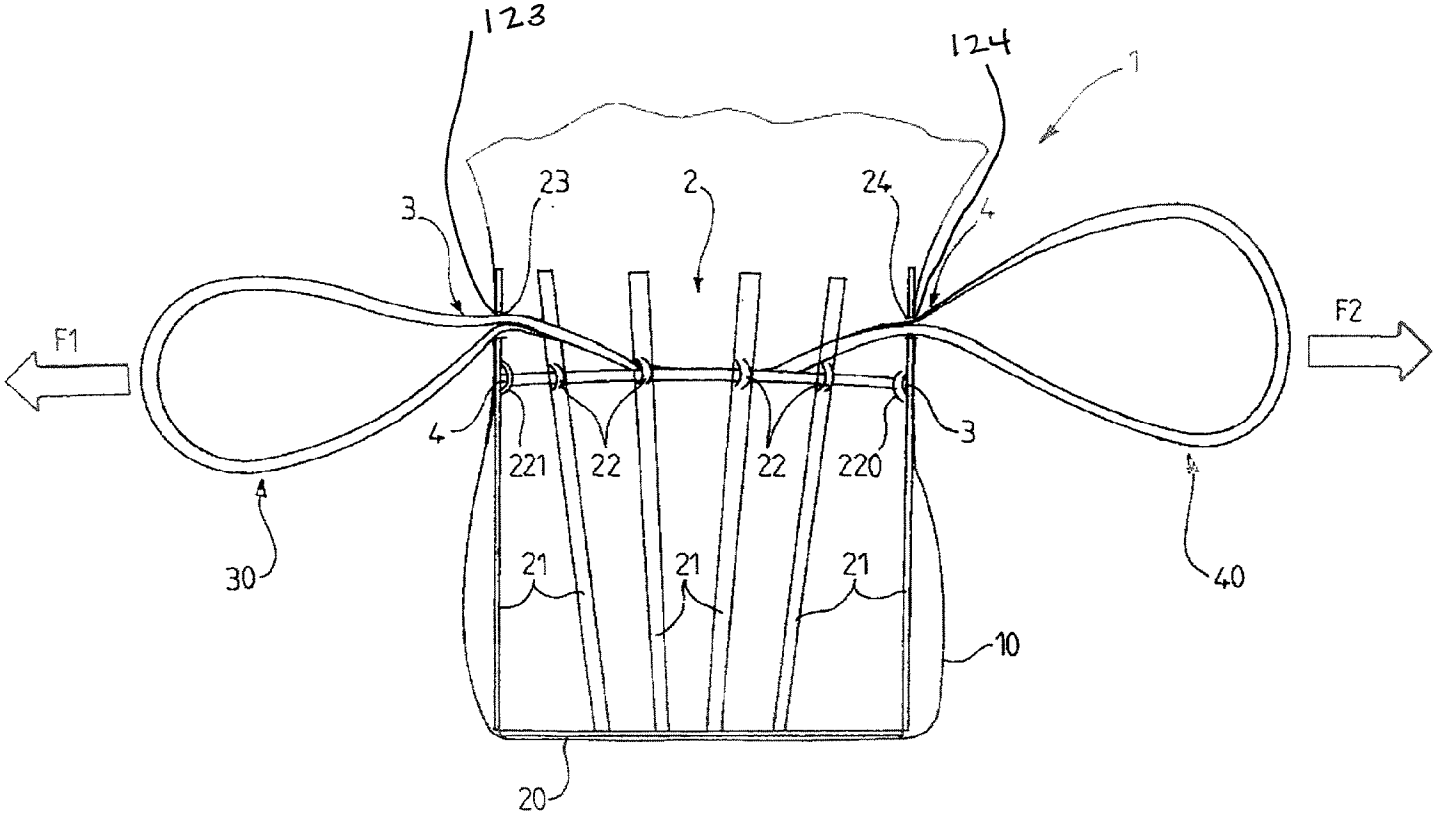
FIG. 7 is a view along a vertical section, illustrating shaping the packaging by pulling on the drawstrings.

Thus the packaging 1 is able to go from a flat position in which the base 20 and the arms 21 of the reinforcing element 2 are roughly in the same plane, illustrated in FIG. 5, to a three-dimensional position, by simultaneously pulling on the two drawstrings 3, 4 and exerting on the grasping areas 30, 40 two forces F1, F2 whose directions are opposite, as illustrated in FIG. 7.

As illustrated in FIG. 5, preferably, the first drawstring 3 passes through loop 220 disposed on arm 210 accommodating orifice 24', which the second drawstring 4 passes through, and the second drawstring 4 passes through loop 221 disposed on arm 211 accommodating orifice 23', which the first drawstring 3 passes through. Such an arrangement specifically allows a uniform force to be exerted on arms 21 by means of the drawstrings 3, 4 and thus uniformly making the packaging 1 three-dimensional.

The parts of arms 21 adjoining orifices 23', 24' are preferably glued to the packaging foil 10, the two drawstrings 3 and 4 passing through two diametrically opposed orifices 123 and 124 in the foil juxtaposed to orifices 23' and 24' of arms 210 and 211, in such a way that the ties exit from the other side of the foil to the outside of the packaging foil 10.

Figure 2:
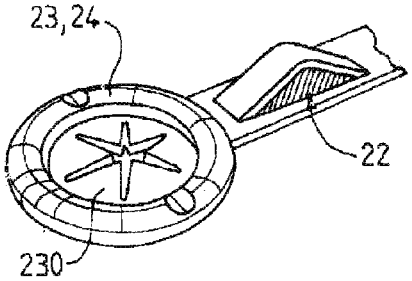
FIG. 2 is a perspective view of the orifice of an arm of the support element.

As illustrated in FIG. 2, according to one embodiment, the first pair of orifices 23 or 24 and the second pair of orifices 23' and 24' include means 230 of tightening the drawstrings, and they thus form a single element with the first orifice 23 or 24 or the second orifice 23' or 24'. These means 230 of tightening consist in particular of an orifice in the shape of a star, so as to hinder the drawstrings 3 and 4 from coming back out. According to one embodiment, the reinforcing element exhibits a first pair of orifices 23, 24, diametrically opposed, and a second pair of orifices 23', 24' with different dimensions. As a function of the width or thickness of the drawstrings, the most suitable pair of orifices 23, 24 or 23', 24' will be chosen for use.

According to one embodiment of the invention, the base 26 of each arm 21 is widened in such a way that the bases 26 butt up against one another in the three-dimensional position of the packaging 1 to form a crown in the three-dimensional position. Such a crown allows, in particular, the foot of the bouquet to be held well when it is set on a plane surface, and it thus allows perforation of the packaging foil 10 by the flower stems disposed in the packaging 1 to be prevented.

The mode of operation to achieve the packaging of the bouquet is as follows.

First of all, the operator, a florist for example, sets the packaging 1 on a plane surface in its flat position, and then seizes the areas for grasping 30, 40 of the two drawstrings 3, 4 with both hands. The operator pulls successively downward until the packaging 1 is in its three-dimensional position and the widened bases 26 of arms 21 butt up against one another, thus forming packaging capable of receiving water and the bouquet of flowers. During this pulling, the arms 21 go from a first position in which they are roughly in the plane of the base to a position in which said arms 21 are roughly inclined relative to the base 20.

The operator can then release the drawstrings 3 and 4, these being held in their position by the means 230 of tightening.

Finally, the operator fills the packaging reservoir formed by the packaging, places the flowers in it, and then perhaps fashions the upper part of the packaging foil 10 in such a way as to render the packaging 1 more aesthetic.

Figure 6:
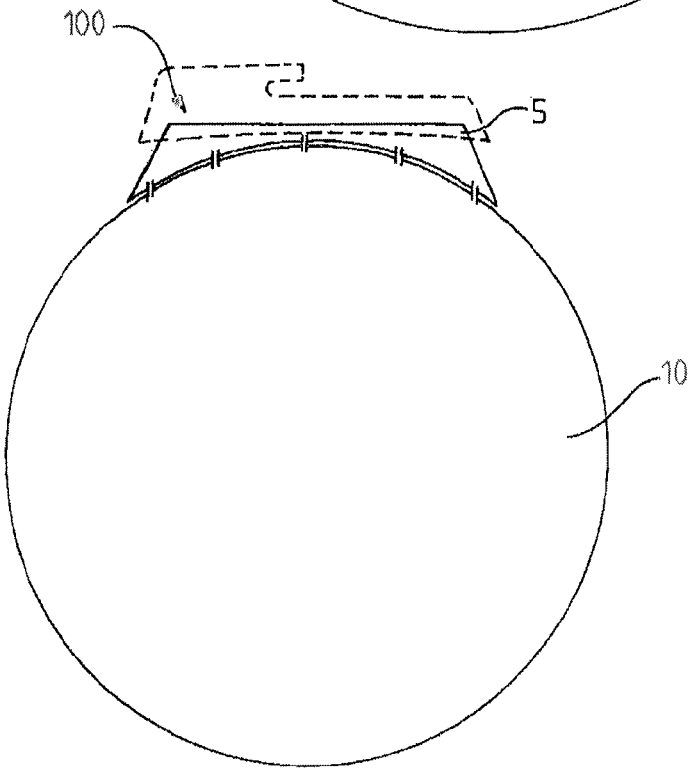
FIG. 6 is an assembly view including a suspension device and a packaging whose packaging foil is provided with a detachable extension.

The invention also concerns an assembly designed to be suspended vertically, illustrated in FIG. 6, and including superposition of several packages 1 conforming to the invention in their flat position, as well as a suspension device 100, depicted by dots, made of cardboard, particularly designed to mutually hold the packages 1 by the intermediary of a detachable extension 5 of each packaging foil 10. The extension 5 can be detached from the foil by the intermediary of a pre-perforated line.

Such an assembly can be suspended on the shelving rods. It is sufficient to pull on one of the packages for it to be detached from the assembly.

Naturally, other embodiments could be envisaged by a person skilled in the art without departing in any way from the scope of the invention defined by the claims hereinafter.

The following nomenclature may be assigned to the numbered elements of the drawings:

1 Packaging
2 Reinforcing element
3 First drawstring
4 Second drawstring
5 Detachable extensions
10 Packaging foil
20 Base of the reinforcing element
21 Arm
22 Loop
23 Orifice (first drawstring 3)
24 Orifice (second drawstring 4)
23' Orifice
24' Orifice
25 Hook
26 Widened base of arm
27 Flexible joints
28 Detachable noose
30, 40 Area for grasping
100 Suspension device
123, 124 Orifices of packaging foil
210, 211 Diametrically opposed arms
220, 221 Diametrically opposed loops
230 Means of tightening

The invention claimed is:

1. A packaging for a bouquet of flowers, the packaging comprising:

a packaging foil impermeable to water and designed to constitute a water reservoir;

a reinforcing element glued onto the packaging foil and designed to shape said packaging, said reinforcing element including:

a base, and a plurality of arms distributed around the base at an angle, the plurality of arms being directed in radial directions around the base and articulated at said base, wherein each of said arms includes a loop in an upper part of the arm;

a first independent drawstring; and a second independent drawstring, said two drawstrings passing successively through at least a number of the loops in the arms, and each drawstring exhibiting an area for grasping, wherein the plurality of arms includes at least one pair of diametrically opposed arms, each of the diametrically opposed arms include an orifice, each of the drawstrings pass through the orifice of each diametrically opposed arm, such that the grasping areas are diametrically opposed, and wherein said packaging can go from a flat position, in which the base and the arms of said reinforcing element are substantially in the same plane, to a three-dimensional position, by pulling simultaneously on the two drawstrings and exerting on the grasping areas two forces in opposite directions.

2. The packaging according to claim 1, in which each orifice includes means of tightening the drawstrings.

3. The packaging according to claim 2, in which the means of tightening form a single element with the orifice.

4. The packaging according to claim 1, in which the drawstrings pass respectively through two orifices in the packaging foil, the two orifices of the packaging foil being respectively juxtaposed to the two orifices of the pair of diametrically opposed arms.

5. The packaging according to claim 1, in which each of the plurality of arms includes a base, and said bases of said arms are widened in such a way as to butt up against one another in the three-dimensional position and form a crown in the three-dimensional position.

6. The packaging according to claim 1, in which each drawstring forms a continuous loop, the area for grasping each of said drawstrings being able to form a noose when said packaging is in the three-dimensional position.

7. The packaging according to claim 1, in which said packaging foil, said reinforcing element, and said drawstrings are of the same plastic material.

8. The packaging according to claim 1, wherein the plurality of arms includes a second pair of diametrically opposed arms, and each of the second pair of diametrically opposed arms exhibits a hook at an end of the arm, the hooks being directed downward.

9. An assembly designed to be suspended vertically and including superposition of a plurality of packages including the packaging of claim 1 in the flat position, the assembly further comprising: a suspension device mutually holding the packages by an intermediary of a detachable extension of each packaging foil.

10. The packaging according to claim 1, wherein the first independent drawstring passes through one of the orifices and a plurality of the loops; and the second independent drawstring passes through another of the orifices and a plurality of the loops.

11. The packaging according to claim 1, wherein the reinforcing element is configured to be substantially flat in at least one position.

12. The packaging according to claim 1, wherein the entire packaging is made from a flexible material.

13. The packaging according to claim 1, wherein at least two of the plurality of arms have different structural features other than the arms' location or orientation.

14. The packaging according to claim 1, wherein the arms include at least three different kinds of arms, the different three kinds of arms being defined by structural features other than location or orientation.

15. The packaging according to claim 1, wherein at least two of the arms have a smooth top surface.

16. A packaging for a bouquet of flowers, the packaging comprising:

a packaging foil;

a reinforcing element secured onto the packaging foil and designed to shape said packaging, said reinforcing element comprising:

a base, and a plurality of arms distributed around the base, the plurality of arms being directed in radial directions around the base and articulated at said base;

a first independent drawstring; and a second independent drawstring;

wherein the plurality of arms includes at least one pair of diametrically opposed arms, each of the diametrically opposed arms including an orifice, said two drawstrings pass respectively through the two orifices of the pair of diametrically opposed arms, and wherein said packaging can go from a flat position, in which the base and the arms of said reinforcing element are substantially in the same plane, to a three-dimensional position, by pulling simultaneously on the two drawstrings and exerting on the grasping areas two forces in opposite directions.

17. The packaging according to claim 16, wherein the entire packaging is made from a flexible material.

18. The packaging according to claim 16, wherein the reinforcing element is configured to be substantially flat in at least one position.

19. The packaging according to claim 16, in which each of the plurality of arms includes a base, and said bases of said arms are widened in such a way as to butt up against one another in the three-dimensional position and form a crown in the three-dimensional position.

20. The packaging according to claim 16, wherein the arms include at least three different kinds of arms, the three different kinds of arms being defined by their structural features other than location or orientation.

* * * * *